US010085492B2

(12) United States Patent
Polidan et al.

(10) Patent No.: US 10,085,492 B2
(45) Date of Patent: Oct. 2, 2018

(54) ADJUSTABLE GARMENT APPARATUS

(71) Applicant: Polidan, Inc., Jacksonville, FL (US)

(72) Inventors: John Polidan, Jacksonville, FL (US); Eric Schifone, Hollis, NH (US)

(73) Assignee: POLIDAN, INC., Jacksonville, FL (US)

( * ) Notice: Subject to any disclaimer, the term of this patent is extended or adjusted under 35 U.S.C. 154(b) by 0 days.

(21) Appl. No.: 15/165,251

(22) Filed: May 26, 2016

(65) Prior Publication Data

US 2016/0278438 A1 Sep. 29, 2016

Related U.S. Application Data

(63) Continuation-in-part of application No. 13/474,031, filed on May 17, 2012, now abandoned.

(51) Int. Cl.
*A41B 9/00* (2006.01)
*A41B 9/02* (2006.01)

(52) U.S. Cl.
CPC ..... *A41B 9/026* (2013.01); *A41B 9/001* (2013.01); *A41B 9/02* (2013.01); *A41B 9/023* (2013.01)

(58) Field of Classification Search
CPC ..... A41B 9/001; A41B 9/007; A41B 9/02; A41B 9/023; A41B 9/026; A41B 9/12; A41B 9/004; A63B 71/1216; Y10S 2/919; A61F 5/40
USPC ..... 2/401, 403–405, 919
See application file for complete search history.

(56) References Cited

U.S. PATENT DOCUMENTS

| | | | | |
|---|---|---|---|---|
| 642,920 | A * | 2/1900 | Potts | A61F 5/40 2/403 |
| 1,206,525 | A | 11/1916 | Force | |
| 1,254,463 | A | 1/1918 | Arrington | |
| 2,254,863 | A | 9/1941 | Weihe | |
| 2,638,899 | A * | 5/1953 | Ambarian | A61F 13/68 604/397 |
| 3,037,503 | A | 6/1962 | Ravaschieri | |
| 3,212,500 | A | 10/1965 | Bardy | |
| 4,660,551 | A | 4/1987 | Nishimura | |
| 4,922,899 | A | 5/1990 | Graff et al. | |
| 4,961,419 | A | 10/1990 | Tribble et al. | |
| 5,070,869 | A | 12/1991 | Zhang | |
| 5,283,912 | A | 2/1994 | Chung | |

(Continued)

FOREIGN PATENT DOCUMENTS

JP WO 2007004423 A1 * 1/2007 ..... A41B 9/023

OTHER PUBLICATIONS

International Search Report and Written Opinion issued in application No. PCT/US2017/033376, dated Aug. 7, 2017 (10 pgs).

*Primary Examiner* — Jameson Collier
(74) *Attorney, Agent, or Firm* — Hayes Soloway P.C.

(57) ABSTRACT

A garment apparatus includes two leg panels, a rear panel, a center panel, and a fly panel, each constructed from a fabric material, wherein the rear panel, the center panel, and the fly panel are connected between the two leg panels, and wherein a lower end of the fly panel extends substantially to a center line of the center panel. At least one conduit is positioned along a seam of the fly panel, wherein the seam is formed at least between the fly panel and the two leg panels and between the fly panel and the center panel. A cord is positioned within the at least one conduit and movable between at least a tensioned state and an untensioned state.

19 Claims, 14 Drawing Sheets

(56) References Cited

U.S. PATENT DOCUMENTS

| | | | | |
|---|---|---|---|---|
| 5,643,643 | A * | 7/1997 | Bernstein | D04D 7/00 156/70 |
| 5,647,065 | A | 7/1997 | Richerson | |
| 5,784,723 | A | 7/1998 | Noble et al. | |
| 5,870,779 | A | 2/1999 | Heron | |
| 6,041,441 | A | 3/2000 | Counts et al. | 2/227 |
| 6,308,340 | B1 | 10/2001 | Cook | |
| 6,901,607 | B1 * | 6/2005 | Elwell | A41B 9/023 2/400 |
| 7,178,174 | B2 | 2/2007 | Soderstrom | |
| 2004/0031088 | A1 | 2/2004 | Soderstrom | 2/227 |
| 2005/0137548 | A1 | 6/2005 | Riley | |
| 2007/0192941 | A1 | 8/2007 | Soderstrom | |
| 2008/0010716 | A1 * | 1/2008 | Brown | A41B 9/023 2/78.1 |
| 2008/0021433 | A1 | 1/2008 | Allison-Rogers | |
| 2009/0106874 | A1 | 4/2009 | Shlush | |
| 2011/0023216 | A1 | 2/2011 | O'Leary | |
| 2011/0173741 | A1 | 7/2011 | Georgis, Jr. | |
| 2011/0307996 | A1 * | 12/2011 | Radford | A41B 9/02 2/404 |
| 2012/0204325 | A1 | 8/2012 | Todd | |
| 2012/0255102 | A1 | 10/2012 | Soderstrom | |
| 2015/0231482 | A1 * | 8/2015 | Ziehler | A63B 71/1216 2/403 |
| 2017/0238619 | A1 * | 8/2017 | Shupe | A41B 9/023 |

* cited by examiner

ADJUSTABLE GARMENT APPARATUS

CROSS REFERENCE TO RELATED APPLICATION

This application is a continuation-in-part application of U.S. patent application Ser. No. 13/474,031 entitled, "Adjustable Undergarment Device and Method" filed May 17, 2012, the entire disclosure of which is incorporated herein by reference.

FIELD OF THE DISCLOSURE

The present disclosure is generally related to clothing and more particularly is related to adjustable garment devices and methods.

BACKGROUND OF THE DISCLOSURE

Men's underwear typically suffers from several inadequacies including but not limited to: lack of support, improper positioning and isolation from direct contact with the inner thigh or perineum areas combined with a high degree of contact between such areas and improper fitting undergarments typically is known to cause friction, chaffing, and discomfort while sitting, walking, running, or other numerous activities and athletic activities. In addition to unwanted contact with the thigh or perineum region and undergarment seams, most undergarments lack appropriate support and positioning for the genitalia, limit freedom of movement, do not provide comfortable natural resting position for the genitalia, lack of moisture control and lack of temperature control. Currently undergarments offer limited sizes, shapes and materials without adjustability for proper fitment failing to isolate the genitalia from making direct contact with inner thighs, perineum region and legs while increasing comfort, support and positioning attributes for male genitalia.

Thus, a heretofore unaddressed need exists in the industry to address the aforementioned deficiencies and inadequacies.

SUMMARY OF THE DISCLOSURE

Embodiments of the present disclosure provide an adjustable garment apparatus. Briefly described, in architecture, one embodiment of the apparatus, among others, can be implemented as follows. The adjustable garment apparatus has two leg panels, a rear panel, a center panel, and a fly panel, each constructed from a fabric material, wherein the rear panel, the center panel, and the fly panel are connected between the two leg panels, and wherein a lower end of the fly panel extends substantially to a center line of the center panel. At least one conduit is positioned along a seam of the fly panel, wherein the seam is formed at least between the fly panel and the two leg panels and between the fly panel and the center panel. A cord is positioned within the at least one conduit and movable between at least a tensioned state and an untensioned state.

The present disclosure can also be viewed as providing a non-suspensory, genital-supportive undergarment apparatus for supporting male genitalia in a pouch. Briefly described, in architecture, one embodiment of the apparatus, among others, can be implemented as follows. The non-suspensory, genital-supportive undergarment apparatus for supporting male genitalia in a pouch includes a plurality of fabric panels including two leg panels, a rear panel, a center panel, and a fly panel, wherein each of the plurality of fabric panels is constructed from a fabric material, wherein the rear panel, the center panel, and the fly panel are connected between the two leg panels with seams therebetween, and wherein a lower end of the fly panel extends past a substantially straight front edge of the center panel and to a center line of the center panel. At least one conduit is positioned along a seam of the fly panel, wherein the seam is formed at least between the fly panel and the two leg panels and between the fly panel and the center panel. A cord is positioned within the at least one conduit and movable between at least a tensioned state and an untensioned state, wherein in the tensioned state, a genitalia pouch is formed in the fly panel.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
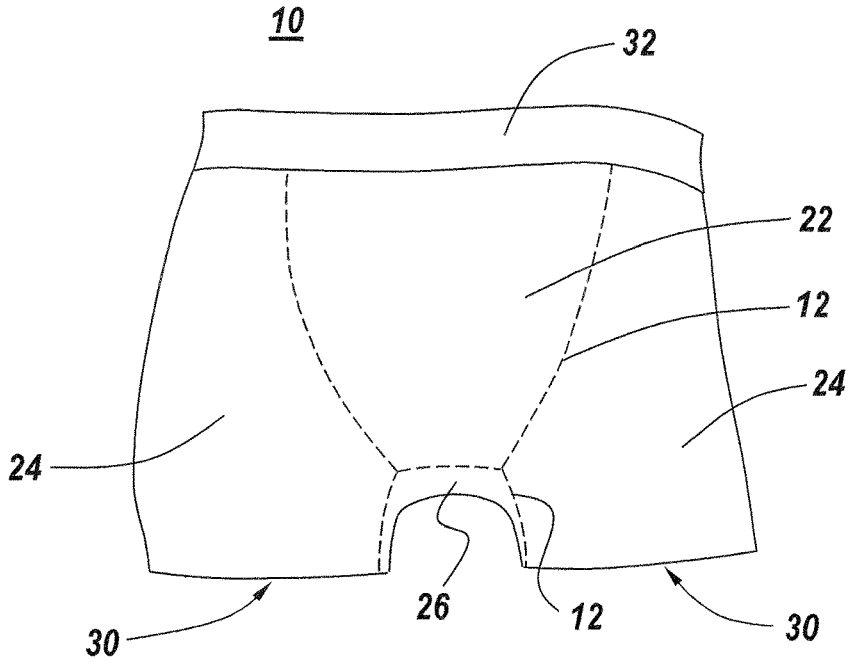
FIG. 1A is a rear view illustration of a garment apparatus, in accordance with a first exemplary embodiment of the present disclosure.
Figure 1B:
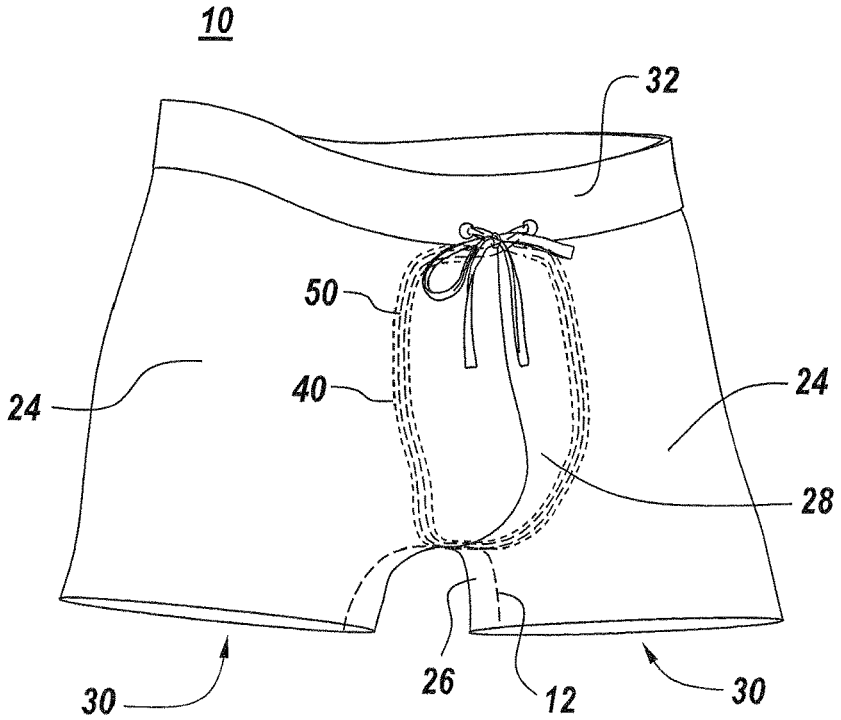
FIG. 1B is a front view illustration of the garment apparatus of FIG. 1A, in accordance with the first exemplary embodiment of the present disclosure.
Figure 1C:
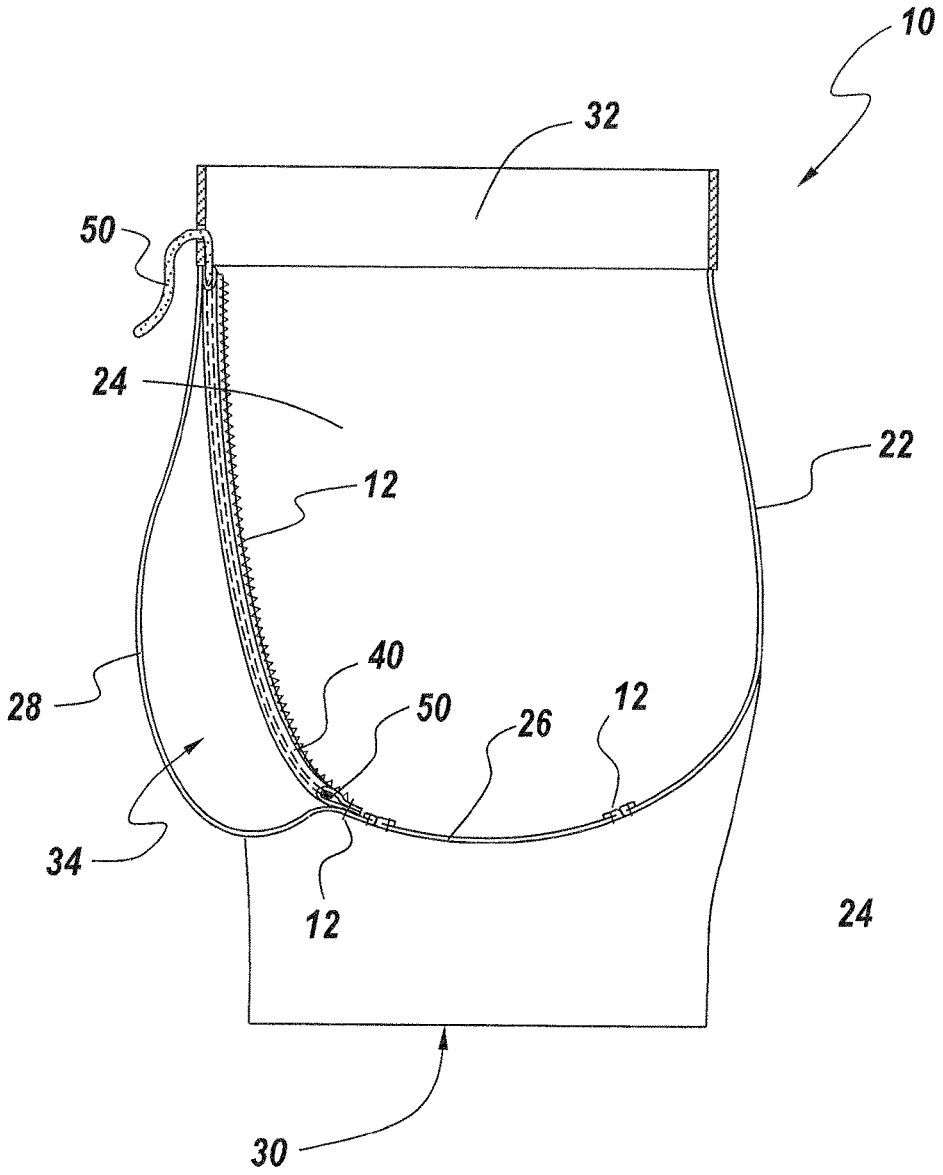
FIG. 1C is a cross-sectional side view illustration of the garment apparatus of FIGS. 1A-1B, in accordance with the first exemplary embodiment of the present disclosure.
Figure 1D:
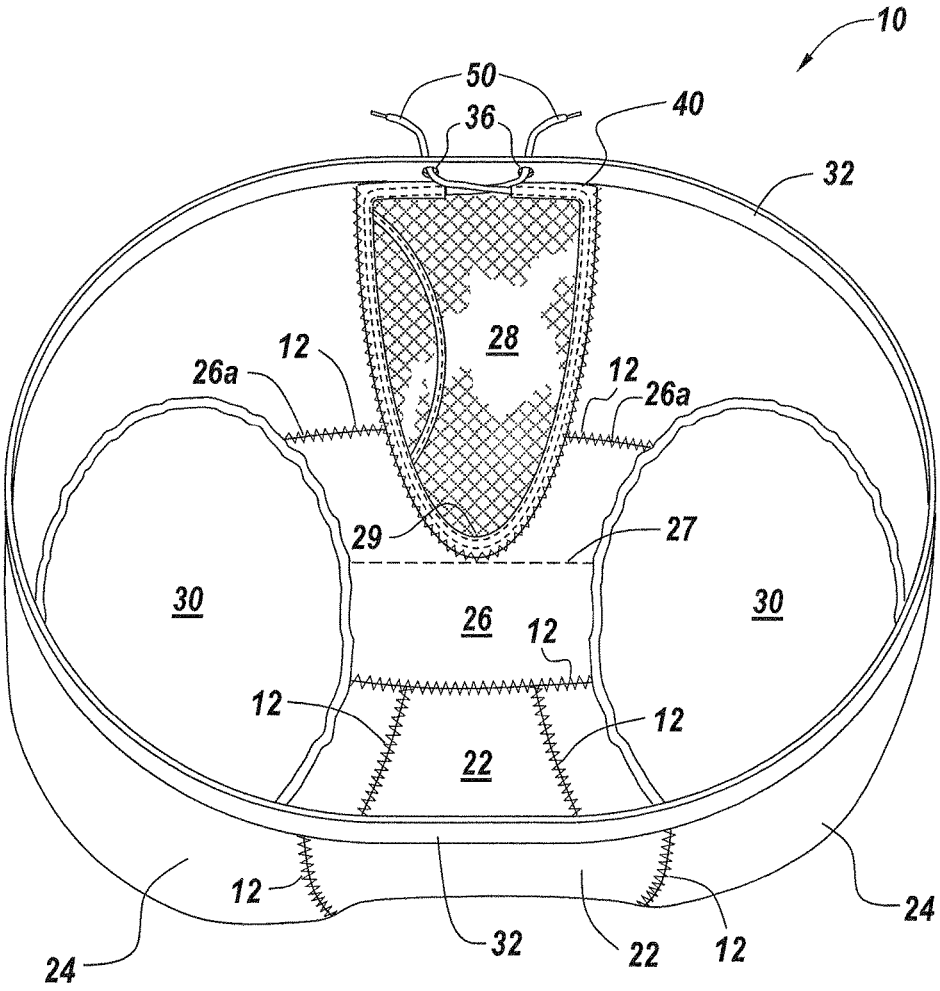
FIG. 1D is an elevated isometric view illustration of the garment apparatus of FIGS. 1A-1B, in accordance with the first exemplary embodiment of the present disclosure.

FIG. 1A is a rear view illustration of a garment apparatus 10, in accordance with a first exemplary embodiment of the present disclosure. FIG. 1B is a front view illustration of the garment apparatus 10 of FIG. 1A, in accordance with the first exemplary embodiment of the present disclosure. FIG. 1C is a cross-sectional side view illustration of the garment apparatus 10 of FIGS. 1A-1B, in accordance with the first exemplary embodiment of the present disclosure. FIG. 1D is an elevated isometric view illustration of the garment apparatus 10 of FIGS. 1A-1B, in accordance with the first exemplary embodiment of the present disclosure. As is shown in FIGS. 1A-1D, the garment apparatus 10, which may be referred to simply as 'apparatus 10' is an article of clothing that may be worn by a human being, namely an adult or juvenile male human being where the apparatus 10 can provide support to the genitals of the adult or juvenile male wearer.

The apparatus 10 is constructed from a plurality of sections of fabric materials 20 which are sewn or otherwise affixed together along with other clothing features to form a completed garment. For example, the plurality of sections of fabric materials 20 may include a rear panel 22 that is generally positioned over a user's buttocks, two leg panels 24 which are connected to the rear panel 22 and generally cover each of the user's legs, a center panel 26 which is positioned between the user's two legs on an underside of the user's crotch, and a fly panel 28 which is generally positioned at a front of the apparatus 10 and over a user's genitals. At the bottom of the apparatus 10, the combination of the leg panels 24 and the center panel 26 may define leg openings 30 in which the user's mid or upper thighs are positioned when the apparatus 10 is worn. At the top of the apparatus 10, the combination of the rear panel 22, the leg panels 24, and the fly panel 28 may be sewn to a waistband 32 which is positioned around a user's torso or waist when the apparatus 10 is worn. Each of the panels of fabric materials 20 may be sewn together at seams 12 using thread and any type of stitching, such as flatlock stitching.

While the rear panel 22 and leg panels 24 may be similar to equivalent panels found in the conventional art, the center panel 26 and the fly panel 28 are unique and provide substantial benefits over the prior art. Specifically, these panels are used in combination with a conduit 40 and a cord 50 positioned generally along the edge of the fly panel 28, which allows the user to adjust the size of the fly panel 28 to constrict the fly panel 28 around the genitalia of the wearer, thereby effectively creating a pouch in the apparatus 10 which can support the user's genitals. The conduit 40 may include a closed channel of fabric which has an elongated interior portion or elongated pocket in which a cord 50 can be positioned. The cord 50 may include any type of material that is used as a drawstring, which may include materials which are durable enough to be placed under tension without breaking. The cord 50 may have any size or length and may be made from a variety of materials. It is often preferable for the cord 50 to be formed from substantially non-stretchable materials, although material that stretches may be used.

The movement of the cord 50 within the conduit 40 may be generally described as movement between two configurations: a first configuration where the cord 50 is relatively free from tension; and a second configuration where the cord 50 is placed under tension. It is noted that any additional number of configurations may be used with the apparatus 10, and the first and second configurations described herein may include variations. When the cord 50 is placed under tension while it is within the conduit 40, it may constrict the conduit 40 and the portions of the fly panel 28 and/or other panels within the apparatus 10. To place the cord 50 under tension or release it therefrom, the cord 50 may be affixed at an end to a structure of the apparatus 10, such as the waistband 32, where the ends of the cord 50 may be tied together after they are tensioned.

The two general configurations of the apparatus 10 can be seen in FIGS. 1C-1D, where FIG. 1C depicts the apparatus 10 with the cord 50 under tension, such that the fly panel 28 forms a pouch 34 in which a user's genitals can be supported when the apparatus 10 is worn. The pouch 34 is a pocket formed by the fly panel 28 which can house the entirety of a male user's genitals together, without separation, i.e., so the testicles and penis of the user are constricted within the pouch 34 together. As shown in FIG. 1C, the conduit 40 is positioned at a seam 12 of the fly panel 28 forming the pouch 34 and the leg panel 24 and center panel 26, such that the conduit 40 generally defines the boundary of the pouch 34. Relative to the anatomy of a male user, when the apparatus 10 is worn and the cord 50 is tensioned to form a pouch 34 in the fly panel 28, the testicles and penis of the male user may be fully positioned within the pouch 34 with the seam 12 between the fly panel 28 and center panel 26 positioned under the perineum region of the user. The configuration where the cord 50 is not tensioned can be seen clearly in FIG. 1D, where the fly panel 28 is generally not constricted to form the pouch 34 of FIG. 1C.

As is shown best in FIG. 1D, the conduit 40 may generally be positioned along the exterior edge of the fly panel 28 such that the conduit 40 occupies a space substantially on the seam 12 between the fly panel 28 and the center panel 26 or leg panels 24. It is noted that other positions and locations of the conduit 40 may also be included, including those that deviate from a seam 12. Further, while FIG. 1D illustrates the seam 12 about the fly panel 28 as being offset from the conduit 40, it is noted that the conduit 40 may be positioned over or just slightly offset from the seam 12, depending on the construction of the apparatus 10. In many cases, the conduit may be sewn into the seam 12 such that the conduit 40 generally lies over the seam 12.

The location of the conduit 40 relative to a user's anatomy when the apparatus 10 is worn may be such that the lowermost portion of the conduit along the center panel 26 may be positioned at the perineum area of the user with the conduit 40 rising upwards towards the waistband 32. At the waistband 32, the conduit 40 may be directed towards a center of the apparatus 10 and the conduit 40 may terminate at a location at or offset from the center of the apparatus 10.

For example, in FIG. 1D, the center of the apparatus 10 is generally positioned between two eyelets 36 in the waistband 32. The cord 50 may exit the terminating end of the conduit 40 and be positioned through one of the eyelets 36 such that an end of the cord 50 can be accessed from a location outside of the apparatus 10. As is shown, the cord 50 may be crossed over itself in the position between the terminating end of the conduit 40 on either side and the eyelets 36. The crossing of the cord 50 may be important in allowing the cord 50 and conduit 40 to form a fully closed pouch 34, e.g., without leaving a gap at the top of the pouch 34. In other words, crossing the cord 50 helps draw together the opposing sides of the fly panel 28 to provide a snugly-fitting pouch 34. It is further noted that the conduit 40 may extend past the eyelets 36 on either side of the apparatus 10, such that the cord 50 remains in a position within the conduit 40 at the location directly below the eyelet 36.

Figure 2:
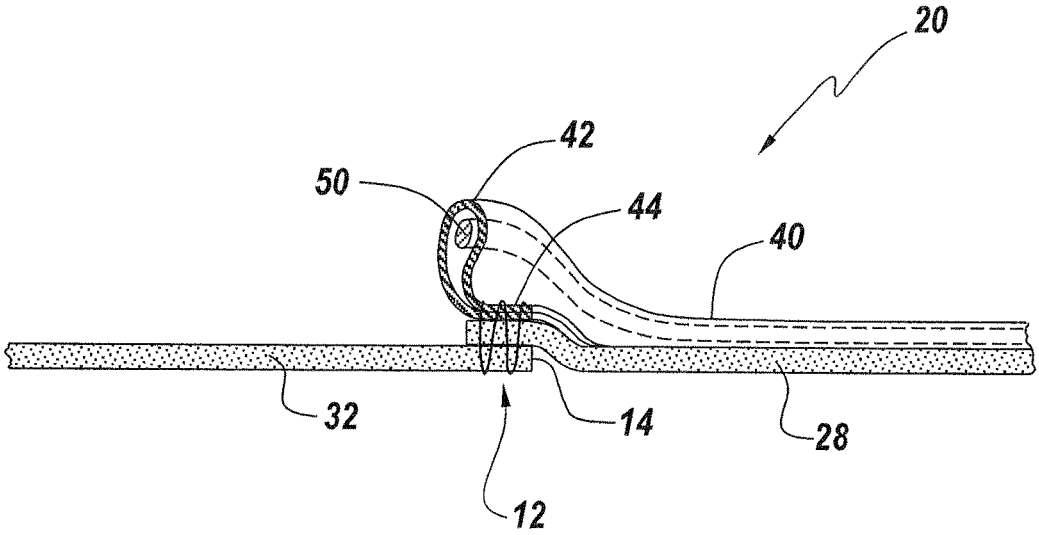
FIG. 2 is a cross-sectional view illustration of the seam and conduit of the garment apparatus of FIGS. 1A-1D, in accordance with the first exemplary embodiment of the present disclosure.

FIG. 2 is a cross-sectional view illustration of the seam 12 and conduit 40 of the garment apparatus of FIGS. 1A-1D, in accordance with the first exemplary embodiment of the present disclosure. As can be seen in FIG. 2, the seam 12 may be formed between two pieces of fabric material. Here, the two illustrated pieces of fabric material include the waistband 32 and the fly panel 28, where the two structures are connected together at the seam 12 with stitching 14. As also shown, the conduit 40 may be positioned directly over the stitching 14 of the seam 12 such that the same stitching 14 may be used to retain the conduit 40 to the seam 12 as is used to retain the waistband 32 to the fly panel 28. The conduit 40 may include a fold-over design or a non-sandwiched design, whereby the conduit 40 is formed from a piece of fabric material that is folded upon itself to the point where its edges meet. The part of the conduit 40 where the edges meet is sewn at the seam 12 to provide a sewn edge 44 of the conduit 40, whereas the opposing edge of the conduit 40 may be understood as a folded edge 42. The interior space of the conduit 40 in which the cord 50 is located may be located proximate to the folded edge 42. The conduit 40 may have the folded edge 42 and the sewn edge 44 along its entire length or a portion thereof. In contrast, a sandwiched conduit design may include two separate pieces of material that are sewn together at their opposing edges, resulting in a conduit 40 that is formed from a sandwiching of two structures. In manufacturing the apparatus 10, the use of the non-sandwiched conduit 40 design may significantly lessen expenses as compared to sandwiched conduit designs.

Figure 3A:
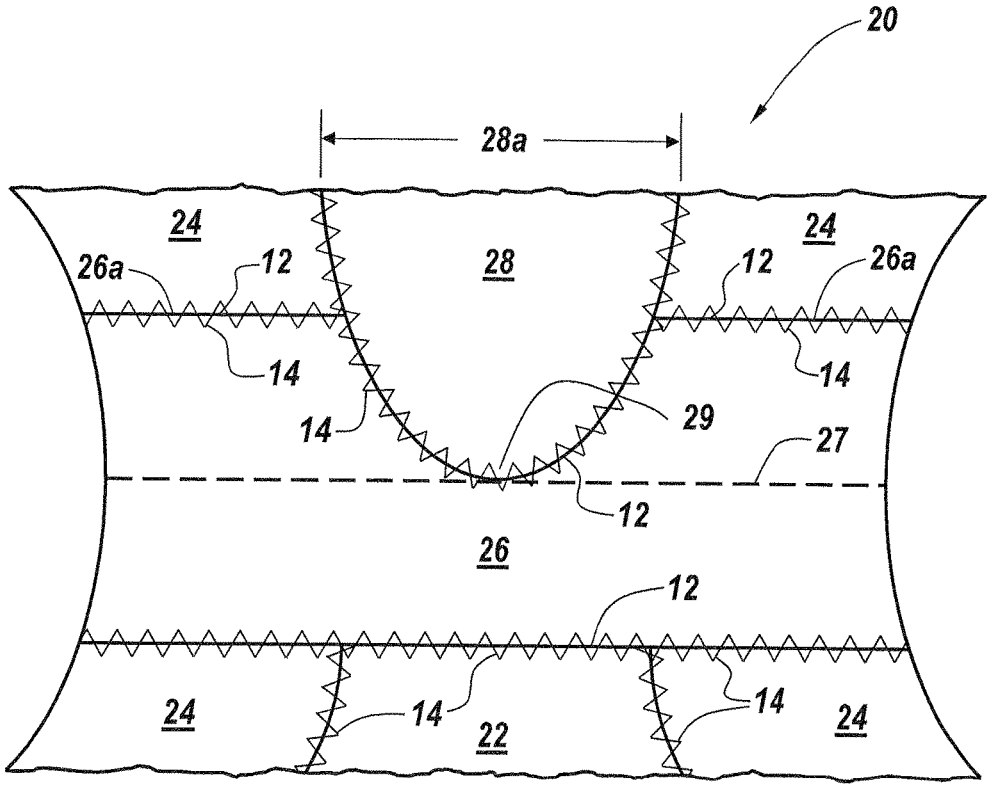
FIG. 3A is a schematic illustration of the center panel and the fly panel of the garment apparatus of FIGS. 1A-1D, in accordance with the first exemplary embodiment of the present disclosure.

FIG. 3A is a schematic illustration of the center panel 26 and the fly panel 28 of the garment apparatus of FIGS. 1A-1D, in accordance with the first exemplary embodiment of the present disclosure. Relative to FIGS. 1A-1D and 3A the center panel 26 of the apparatus 10 may be connected to the fly panel 28, the leg panels 24, and the rear panel 22 with stitching 14 at a number of seams 12. To improve the comfort of using the apparatus 10, e.g., to decrease pinching of the scrotum and to prevent the apparatus 10 from 'riding up' in the buttocks of the user, the fly panel 28 may be extended into a cutout of the center panel 26. For example, the lower edge 29 of the fly panel 28 may extend beyond a front edge 26*a* of the center panel 26 towards a midpoint 27 of the center panel 26. The terminating part of the lower edge 29 may be positioned substantially at a center line 27 or half-way point across the center panel 26, or close to the center line 27.

Figure 3B:
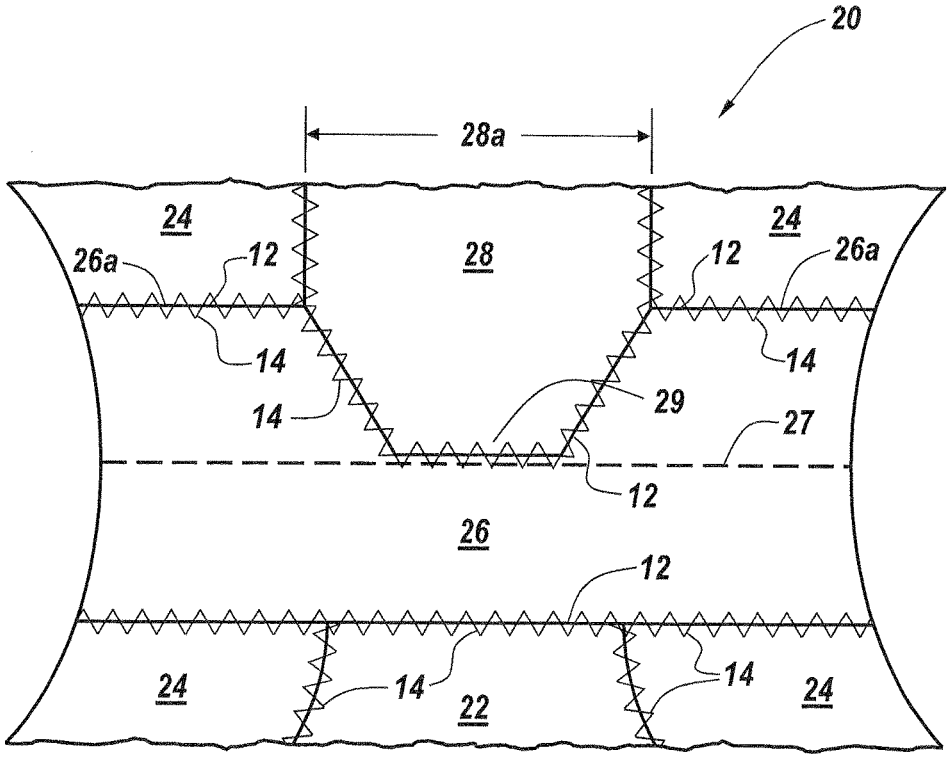
FIG. 3B is a schematic illustration of the center panel and the fly panel of the garment apparatus of FIGS. 1A-1D, in accordance with the first exemplary embodiment of the present disclosure.
Figure 3C:
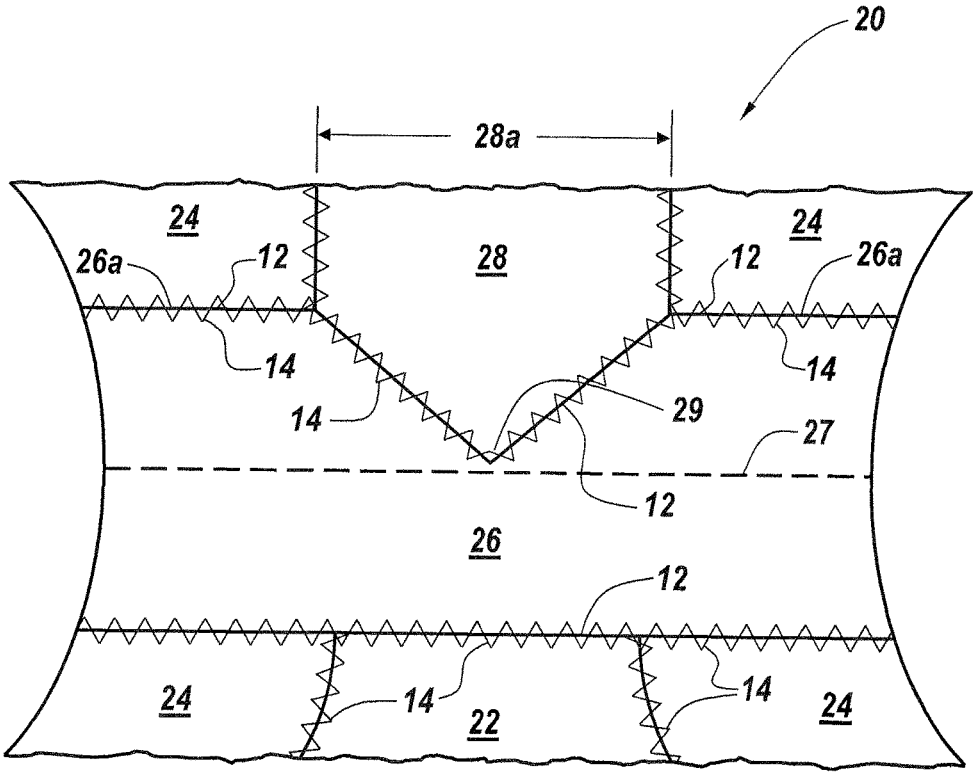
FIG. 3C is a schematic illustration of the center panel and the fly panel of the garment apparatus of FIGS. 1A-1D, in accordance with the first exemplary embodiment of the present disclosure.

The shape of the lower edge 29 may include a curved arch shape, as shown in FIGS. 1D and 3A, where the seam 12 along the lower edge 29 forms a curve along a radius, the curve extending between the intersection of the seam between the fly panel 28 and the front edge 26*a* of the center panel 26. Extending the lower edge 29 of the fly panel 28 along a curve results in the conduit path along the lower edge 29 being larger than a width dimension 28*a* of the fly panel 28. FIG. 3B is a schematic illustration of the center panel 26 and the fly panel 28 of the garment apparatus of FIGS. 1A-1D, in accordance with the first exemplary embodiment of the present disclosure. Contrasting from FIG. 3A, FIG. 3B illustrates the lower edge 29 of the fly panel 28 as extending to the center line 27 of the center panel 26 with an angular shape, namely, a trapezoid shape, where a straight edge of the lower edge 29 is positioned substantially parallel and aligned with the center line 27. Here, the shape of the lower edge 29 may have a straight edge from the intersection of the front edge 26*a* and the fly panel 28 to the center line 27, and a straight line along the center line 27. Yet another design is shown in FIG. 3C, which is a schematic illustration of the center panel and the fly panel of the garment apparatus of FIGS. 1A-1D, in accordance with the first exemplary embodiment of the present disclosure. Here, it can be seen that the lower edge 29 of the fly panel 28 extends to the center line 27 of the center panel 26 with a triangular shape, where a vertex of the triangle is positioned substantially at the center line 27 of the center panel 26. The sides of the triangle shape may extend in a straight path directly from a corner of each of the leg panels 24, respectively, and the fly panel 28 to a substantial center point of the center panel 26, both in terms of length and width thereof.

It is further noted that the position of the terminating end of the fly panel 28 into the center panel 26 can vary, depending on the design of the apparatus. For example, it many situations, it may be preferable for the junction of the fly panel 28 and the lower edge 29 or the center panel 26 to be positioned at the center line 27 of the center panel 26. In other designs, the location of the junction may be specified by a dimensional distance from the front edge 26*a* of the center panel 26. For example, the junction may be positioned 0 cm to 6 cm, or a larger distance, from the front edge 26*a*, depending on the design of the apparatus, and in some situations the junction may extend to the back edge (back seam) of the center panel 26. While the conduit 40 (FIGS. 1B-1D) is not depicted in FIGS. 3A-3C, it is noted that the conduit may run along the seam between the fly panel 28 and the adjacent panels, e.g., along the perimeter of the fly panel 28.

It is noted that the conduit 40 may include different features, characteristics, or designs to improve the functioning and use of the apparatus 10. For example, the conduit 40 may include a single conduit structure which extends fully in an unbroken manner between terminating ends of the conduit 40, as shown in FIG. 1D. Other designs may include anchoring the cord 50 within the conduit 40 at a specific location to prevent the cord 50 from inadvertently being withdrawn fully from the conduit 40. Additionally, anchoring the cord 50 within the conduit 40 may allow the cord 50 to constrict the fly panel 28 at a selected point on the conduit 40.

Figure 4A:
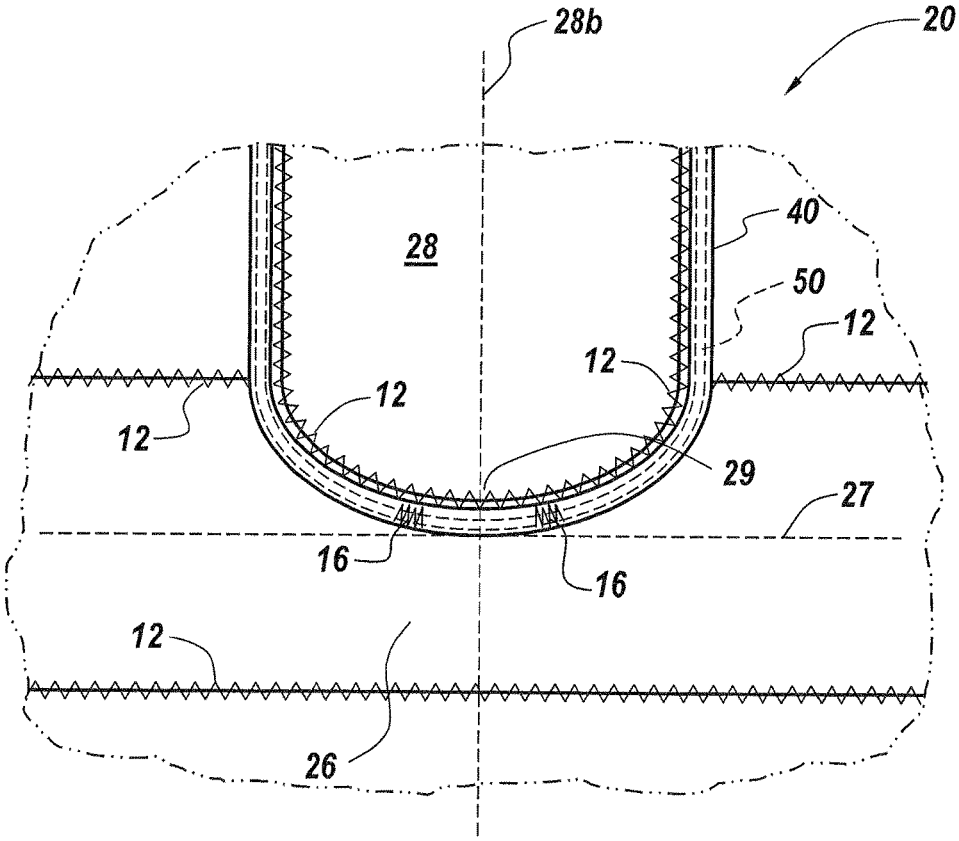
FIG. 4A is a schematic illustration of the conduit and cord at the center panel and the fly panel of the garment apparatus of FIGS. 1A-1D, in accordance with the first exemplary embodiment of the present disclosure.

As an example, FIG. 4A is a schematic illustration of the conduit 40 and cord 50 at the center panel 26 and the fly panel 28 of the garment apparatus of FIGS. 1A-1D, in accordance with the first exemplary embodiment of the present disclosure, where the cord 50 is anchored to the conduit 40 with anchoring stitches 16 at two locations near the center line 27 of the center panel 26. The anchoring stitches 16 may include thread which is engaged between sidewalls of the conduit 40 and the length of cord 50 proximately adjacent. While two anchoring stitches 16 are illustrated, it may be possible to use any number of anchoring stitches 16, including one. In testing, it has been found that using two anchoring stitches 16 on either side of a midpoint 28*b* of the fly panel 28 may prevent the anchor stitches 16 from being located over the perineal raphe of the user, thereby preventing the anchor stitches 16 from irritating the user's perineal raphe or nearby anatomical regions. When the design illustrated in FIG. 4A is used, tensioning the cord 50 on either side of the fly panel 28 may result in the cord 50 pulling equally on the lower edge 29 of the fly panel 28.

Figure 4B:
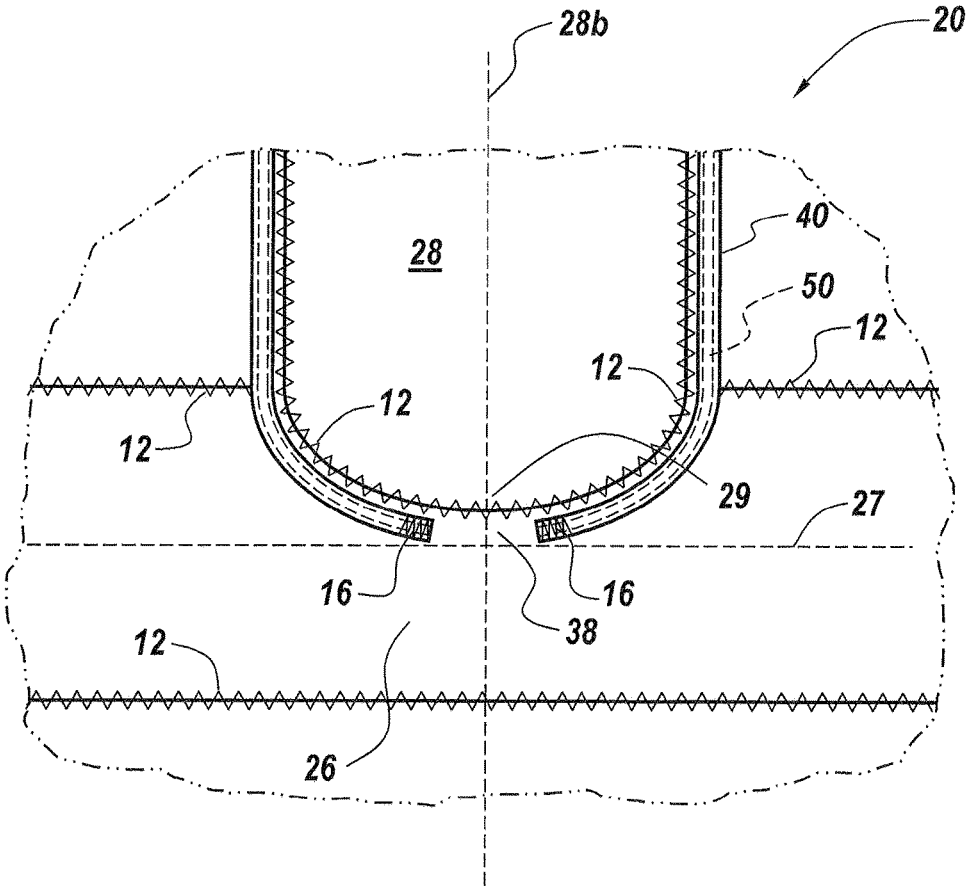
FIG. 4B is a schematic illustration of the conduit and cord at the center panel and the fly panel of the garment apparatus of FIGS. 1A-1D, in accordance with the first exemplary embodiment of the present disclosure.

FIG. 4B is a schematic illustration of the conduit 40 and cord 50 at the center panel 26 and the fly panel 28 of the garment apparatus of FIGS. 1A-1D, in accordance with the first exemplary embodiment of the present disclosure. Similar to the design of FIG. 4A, FIG. 4B illustrates a design where the cord 50 is anchored to the conduit 40 with anchoring stitches 16 at two locations near the center line 27 of the center panel 26. The anchoring stitches 16 may include thread which is engaged between sidewalls of the conduit 40 and the length of cord 50 proximately adjacent. To further prevent irritation of a user's perineum raphe, a gap 38 in the conduit 40 may be formed between the anchor stitches 16. The gap 38 may be formed by terminating the conduit 40 at the anchor stiches 16, such that the gap 28 (absence of the conduit 40) is located over the midpoint 28*b* of the fly panel 28. Again, in testing, it has been found that using two anchoring stitches 16 on either side of a midpoint 28*b* of the fly panel 28 and removing the section of the conduit 40 therebetween to form the gap 38 may further prevent the anchor stitches 16 or conduit 40 from irritating the user's perineal raphe or nearby anatomical regions.

Figure 5A:
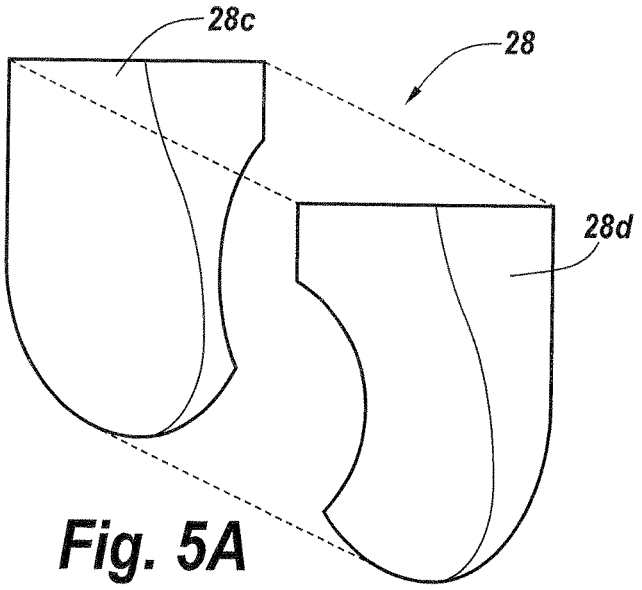
FIGS. 5A-5C are various schematic illustrations of a multi-piece fly panel of the garment apparatus of FIGS. 1A-1D, in accordance with the first exemplary embodiment of the present disclosure.
Figure 5B:
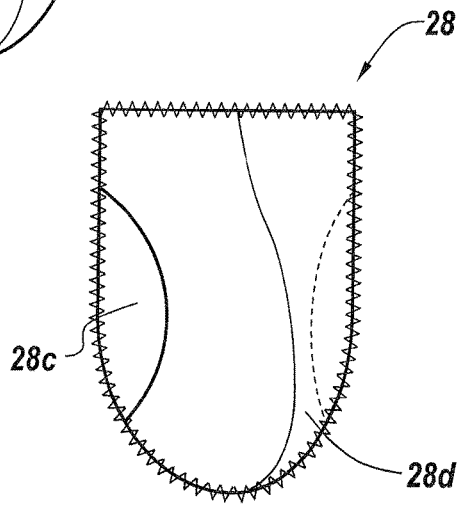
Figure 5C:
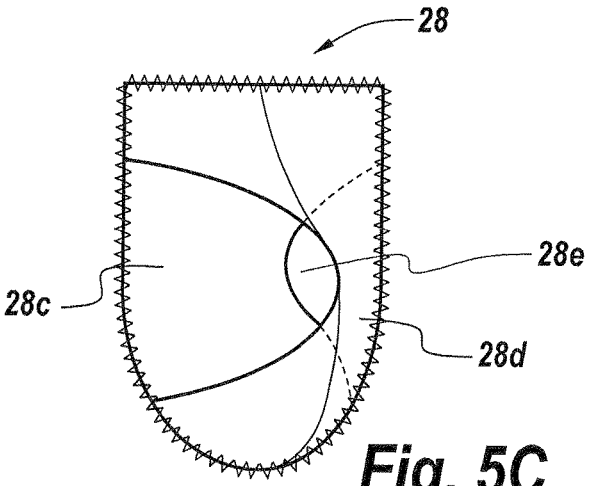

The fly panel 28 of the apparatus 10 may include varied designs. For example, in one design, the fly panel 28 may be formed from a single piece of material or from multiple pieces of material. FIGS. 5A-5C are various schematic illustrations of a multi-piece fly panel 28 of the garment apparatus of FIGS. 1A-1D, in accordance with the first exemplary embodiment of the present disclosure. Specifically, FIGS. 5A-5C illustrate a fly panel 28 formed from two fabric materials 28*c*, 28*d* overlaid on one another. The two fabric materials 28*c*, 28*d* may have separate shapes, as shown in FIG. 5A. For example, one of the pieces 28*c* may have a right-hand facing cutout, whereas the other piece 28*d* may have a left-hand facing cutout. When they are overlaid on one another, as shown in FIG. 5B, the fly panel 28 is fully closed since the cutouts of the pieces 28*c*, 28*d* are overlapping the non-cutout region. The fly panel 28 being fully closed means that there are no continually open holes or slots formed through the fly panel 28. Rather, the fly panel 28 must be manipulated by a user to create an open hole 28*e*, e.g., by pulling the cutouts of each piece 28*c*, 28*d* towards each other until the open hole 28*e* is formed, as shown in FIG. 5C. It is advantageous for the fly panel 28 to not have continually open holes, since doing so would decrease the support provided by the pouch. Accordingly, the apparatus 10 greatly differs from conventional devices known as suspensories which employ a permanent hole in the fly area for the penis to protrude through, and often also have a partition of fabric positioned between the user's scrotum and penis such that the user's penis is positioned in a separate area in the garment than the user's scrotum. In accordance with this disclosure, suspensories are characterized and understood as including those devices which have a continually open hole within fabric for the penis to be positioned through, such that the penis is at least partially separated from the scrotum. The apparatus 10 may include a fly panel 28 which offers the ability to create a temporary portal through hole 28*e* for urination and it does not have a partition between to separate the penis from scrotum.

Figure 6A:
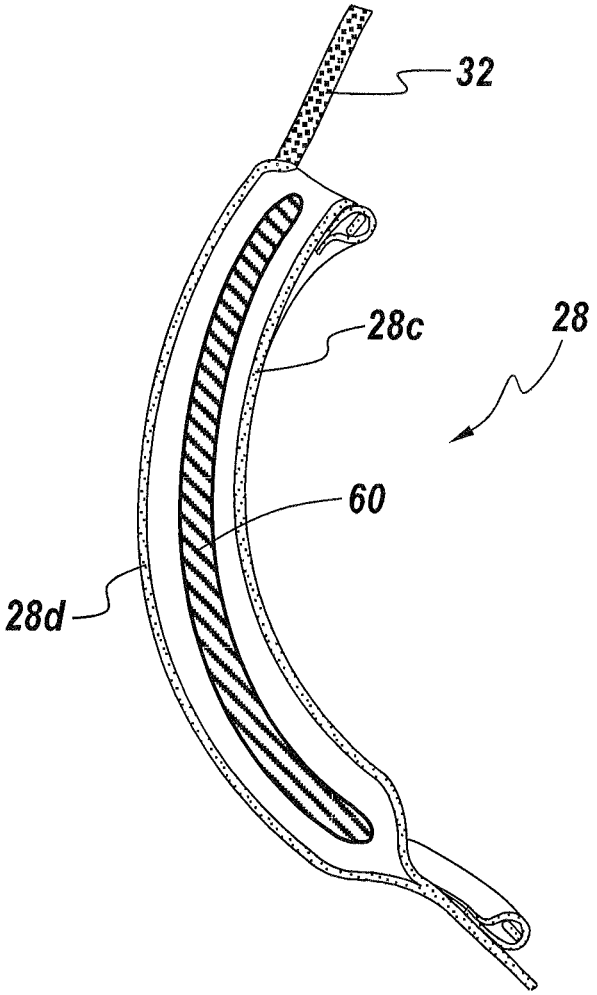
FIGS. 6A-6B are cross-sectional side view and elevated front view illustrations of a panel of the garment apparatus of FIGS. 1A-1D, in accordance with the first exemplary embodiment of the present disclosure.
Figure 6B:
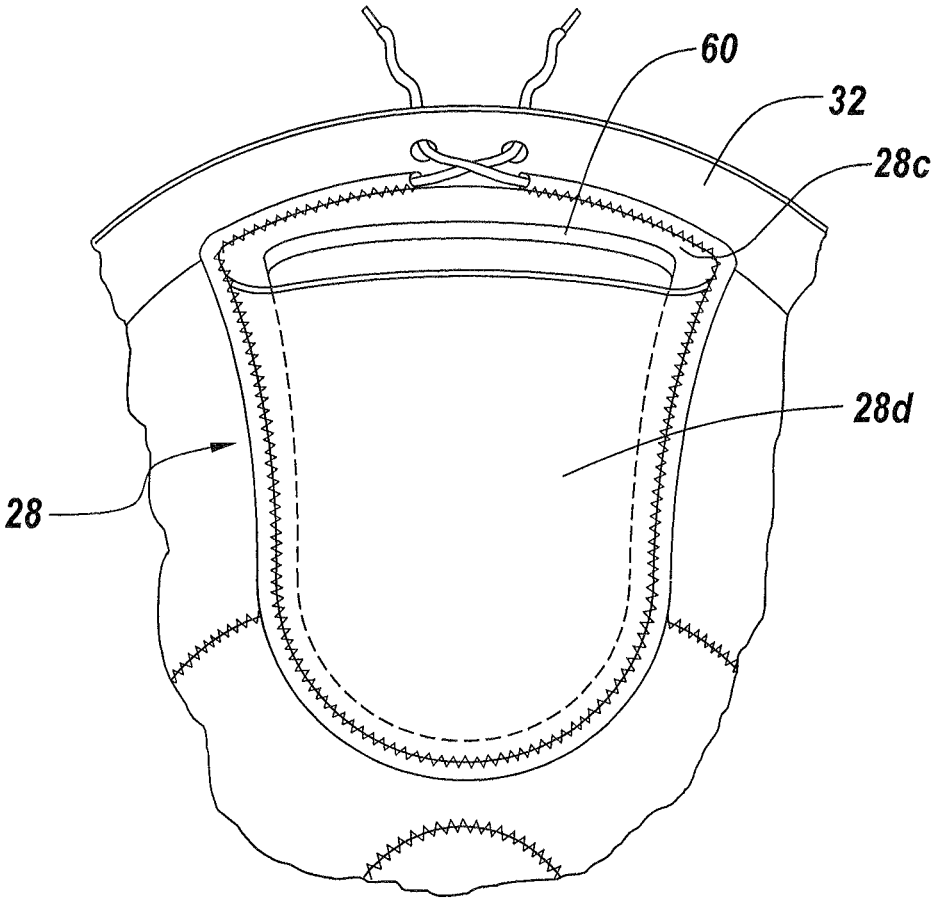

FIGS. 6A-6B are cross-sectional side view and elevated front view illustrations of a panel 28 of the garment apparatus of FIGS. 1A-1D, in accordance with the first exemplary embodiment of the present disclosure. Specifically, the design of FIGS. 6A-6B depicts the use of a two-part fly panel 28 which can receive a hard protective device 60, such as a cup for protection of the genitals. The two-part fly panel 28 has a first piece 28*c* which is positioned as the interior of the fly panel 28 and a second piece 28*d* which is positioned as the exterior side. Between the first and second pieces 28*c*, 28*d*, a pocket is formed which is sized to receive the hard protective device 60. When the hard protective device 60 is positioned in the pocket, the cord 50 may be tensioned within the conduit 40 to constrict the fly panel 28 about the hard protective device 60 and the user's genitals. The hard protective device 60 may have a concave shape to receive the user's genitals therein.

Figure 6C:
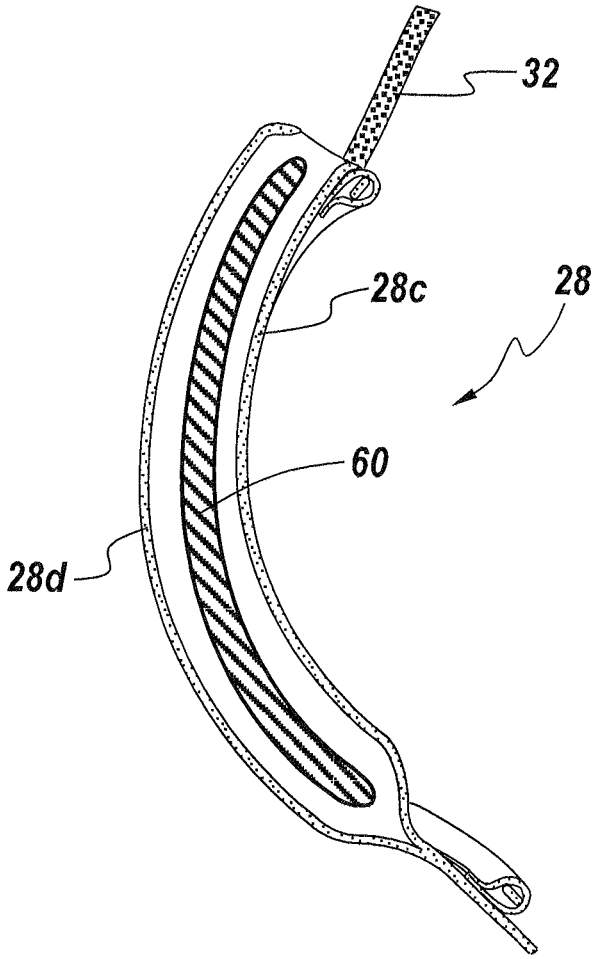
FIG. 6C is a cross-sectional side view and elevated front view illustrations of a panel of the garment apparatus of FIGS. 1A-1D, in accordance with the first exemplary embodiment of the present disclosure.

FIG. 6C is a cross-sectional side view and elevated front view illustrations of a panel 28 of the garment apparatus of FIGS. 1A-1D, in accordance with the first exemplary embodiment of the present disclosure. Specifically, the design of FIG. 6C depicts the use of a two-part fly panel 28 which can receive a medical cooling device 62, such as an ice pack or a cold compress. The medical cooling device 62 may offer important benefits for patients who are required to apply cold temperatures to their genital area, such as patients of surgical procedures concerning the genital area such as vasectomy or prostate surgery. This design may also be used for the insertion of a hard protective device to be used for testicular impact protection. The two-part fly panel 28 has a first piece 28*c* which is positioned as the interior of the fly panel 28 and a second piece 28*d* which is positioned as the exterior side. Between the first and second pieces 28*c*, 28*d*, a pocket is formed which is sized to receive the medical cooling device 62 through an opening in the pocket positioned exterior of the waistband 32. When the medical cooling device 62 is positioned in the pocket, the cord 50 may be tensioned within the conduit 40 to constrict the fly panel 28 about the medical cooling device 62 and the user's genitals to secure the user's genitals within a concave side of the medical cooling device 62. It is noted that the ability to maintain the medical cooling device 62 in a stationary, position proximate to the user's genitals with the cord 50 and conduit 40 may achieve significant benefits over conventional devices, which typically just place the medical cooling device 62 in the desired location and rely on the inherent elasticity of the garment fabric to keep it in place. The ability to control the location of the medical cooling device 62 with the cord 50 and conduit 40 ensures the proper anatomical location will receive the desired cooling effect.

Figure 6D:
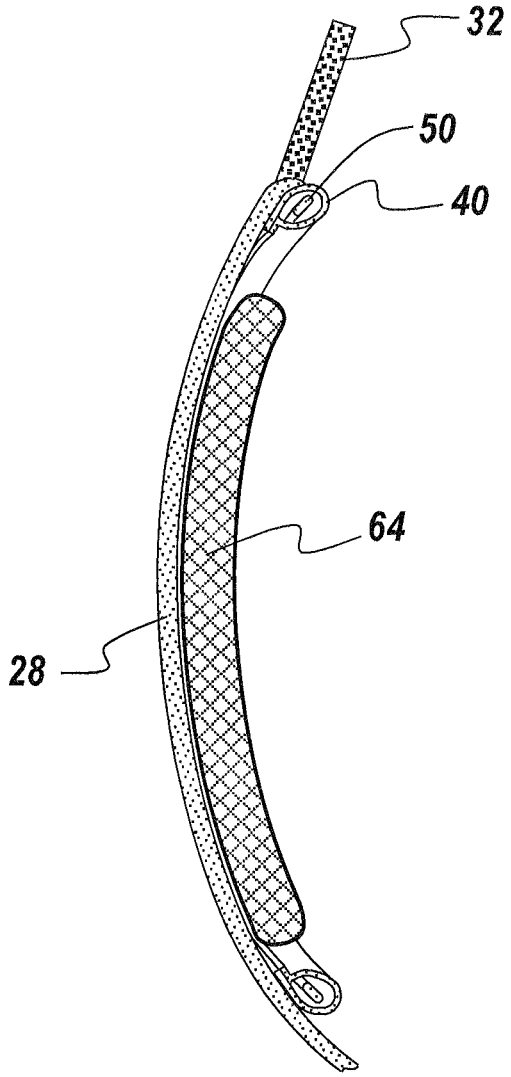
FIG. 6D is a cross-sectional side view and elevated front view illustrations of a panel of the garment apparatus of FIGS. 1A-1D, in accordance with the first exemplary embodiment of the present disclosure.

FIG. 6D is a cross-sectional side view and elevated front view illustrations of panel of the garment apparatus 10 of FIGS. 1A-1D, in accordance with the first exemplary embodiment of the present disclosure. The garment apparatus 10 may provide significant benefits in retaining other medical and non-medical devices in specific locations relative to a user's anatomy. For example, medical pads, gauzes, and absorbent devices can be retained proximate to a user's genitals to provide the desired effect for the user for long periods of time without the device changing position. As is shown in FIG. 6D, it is possible to use liquid absorbent devices 64 in a position on the interior side of the fly panel 28 without a pocket (or interior of the fly panel 28 with a pocket, or within the pocket itself, in some situations), locked in place using the cord 50 and conduit 40, to assist with male urinary incontinence. The liquid absorbent devices may include various types of disposable incontinence guards which may contain liquid absorbing gel. Conventional devices are often full-garment devices which a user must wear as conventional underwear, e.g., diapers such as the DEPENDS® brand devices, or they are absorbent pads which are secured to a garment with a light adhesive. If the absorbent device moves from the desired location and a user suffers from incontinence, the user's urine will miss the pad and result their clothing getting wet. The use of the cord 50 with conduit 40, as described herein, may provide more successful retention of pads or other devices in a desired anatomical location for long periods of time without the use of adhesives between the absorbent pad 64 and the fly panel 28 or full-garment diapers, so incontinence accidents are prevented.

It is noted that the use of the medical cooling device 62 of FIG. 6C may be used in place of the absorbent pad of FIG. 6D. For example, the medical cooling device may be positioned on the fly panel 28 and the cord 50 with conduit 40 may retain the medical cooling device in place next to the desired anatomical location for long periods of time without the use of adhesives between the medical cooling device and the fly panel 28. This use of the medical cooling device without be positioned within a pocket may provide the same or similar benefits to users as described with respect to FIG. 6C.

The garment apparatus 10 may be employed as a variety of different garments, including underwear garments, the liner of swimwear, running shorts, or similar articles of clothing where additional support of the male genitalia is desired. While the apparatus 10 is described as a stand-alone garment, it is noted that it may be used in combination with known garments. For example, the apparatus 10 may be adapted to provide support to male genitalia in bathing suits and swimwear, in athletic wear such as football pants, running shorts, in hiking pants, in any style of underwear including jockstraps, thongs, briefs, trunks, boxer briefs, or any other type of garment. It is further noted that the garment apparatus 10 may be used by everyone including athletes, laborers, medical patients, inactive wearers and others.

It is noted that the quantity of fabric materials 20 may include any type of fabric or fabric-like material that is formed in any size or configuration. The waistband 32 may generally be formed from an elastic material that is sized to sit on the waist of the user. Although the apparatus 10 may include a variety of holes and openings, at least two leg holes 30 are formed at a lower portion of the apparatus 10 to accommodate the legs of the user. Materials may include but are not limited to flexible or non-flexible fabrics, flexible or non-flexible material, breathable or non-breathable materials, etc.

In a specific example, it may be advantageous to employ different types of fabric materials for different panels used in the apparatus 10. For example, the rear panel 22, the leg panels 24, and the center panel 26 may employ a comfortable material like polyester which has a low stretchability. This type of material may include 160 GSM, 10% Elastane (Spandex), and 90% polyester, which may have a 15% stretch at 85 GR. In another example, these panels may be formed from a viscose body that includes 190 GSM, 5% Elastane (Spandex), and 95% Viscose (Rayon) from bamboo. In contrast, the fly panel 28 may be constructed to be significantly more stretchable to allow the fly panel 28 to be constricted when the cord 50 is tensioned. For example, the fly panel 28 may be formed from 170 GSM Jacquard mesh having 10% Elastane (Spandex), 90% polyester, and having a 4-way stretch with qualities of 27% stretch at 85 GR. In another example, the fly panel 28 has 130 GSM with Nylon Jacquard and having a 4-way stretch with qualities of 27% stretch at 85 GR. The ability of the fly panel to have a 4-way stretch means that the material can stretch in at least four degrees of freedom, thereby allowing it to constrict about the genitalia without loose or non-constricted areas.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An adjustable garment apparatus comprising:

two leg panels, a rear panel, a center panel, and a fly panel, each constructed from a fabric material, wherein the rear panel, the center panel, and the fly panel are connected between the two leg panels, wherein the center panel has front, spaced apart edges defining forward boundaries of the center panel, wherein a horizontal of the center panel is positioned at a half-way point between the front, spaced apart edges and a rear edge of the center panel, and wherein a lower end of the fly panel extends downwardly front, spaced apart edges of the center panel and substantially to the horizontal of the center panel;

at least one conduit positioned along a seam of the fly panel, wherein the seam is formed at least between the fly panel and the two leg panels and between the fly panel and the center panel; and a cord positioned within the at least one conduit and movable between at least a tensioned state and an untensioned state.

2. The adjustable garment apparatus of claim 1, wherein the fabric material of the fly panel has a higher stretchability than the fabric material of each of the two leg panels, the rear panel, and the center panel.

3. The adjustable garment apparatus of claim 1, wherein the fabric material of the fly panel is stretchable in at least four degrees of freedom.

4. The adjustable garment apparatus of claim 1, wherein the at least one conduit along the seam at the lower end of the fly panel is positioned in a curved shape having a radius.

5. The adjustable garment apparatus of claim 1, wherein the at least one along the seam at the lower end of the fly panel is positioned in a trapezoid shape having at least one straight path aligned with the center line of the center panel.

6. The adjustable garment apparatus of claim 1, wherein the at least one conduit has terminating ends at two locations adjacent to a waistband, and wherein the cord has two ends, wherein the two ends of the cord exit the terminating ends of the a respective conduit and are each positioned through at least one eyelet within the waistband.

7. The adjustable garment apparatus of claim 6, wherein a first portion of the cord crosses over a second portion of the cord in a position between the terminating ends of the at least one conduit and before the cord is positioned through the at least one eyelet.

8. The adjustable garment apparatus of claim 6, wherein the terminating ends of the at least one conduit at the two locations adjacent to the waistband have a separated distance that is less than a separated distance between the eyelets.

9. The adjustable garment apparatus of claim 6, wherein respective terminating points of the two ends of the cord are configured to be tied together in a position exterior of the waistband.

10. The adjustable garment apparatus of claim 1, wherein the cord is anchored to the at least one conduit with at least one anchor stitch, wherein the at least one anchor stitch is positioned on the lower end of the fly panel.

11. The adjustable garment apparatus of claim 1, wherein the fly panel forms a genitalia pouch when the cord is position in the tensioned state.

12. The adjustable garment apparatus of claim 1, wherein the fly panel further comprises at least two panel pieces, wherein the panel pieces are overlaid on one another.

13. The adjustable garment apparatus of claim 12, wherein the fly panel, between exterior and on the fly panel, is fully closed.

14. The adjustable garment apparatus of claim 1, wherein the at least one conduit comprises a fold-over conduit.

15. A non-suspensory, genital-supportive undergarment apparatus for supporting male genitalia in a pouch, the genital-supportive undergarment apparatus comprising:

a plurality of fabric panels including two leg panels, a rear panel, a center panel, and a fly panel, wherein each of the plurality of fabric panels is constructed from a fabric material, wherein the rear panel, the center panel, and the fly panel are connected at seamed junctions thereof, respectively;

at least one conduit positioned along at least bottom and side peripheral edges of the fly panel following a path of a seam of the fly panel, wherein the seam is formed at least between the fly panel and the two leg panels and between the fly panel and the center panel; and a cord positioned within the at least one conduit and movable between at least a tensioned state and an untensioned state, wherein in the tensioned state, a genitalia pouch is formed by the fly panel, and wherein there are no partitions between the genitalia pouch and an interior of the genitalia-supportive undergarment apparatus, such that the fly panel has a vertical center line that bisects the fly panel, wherein the fabric material of the fly panel extends continuously between a lowermost end and a topmost end of the fly panel and is coincident with the vertical center line.

16. The genital-supportive undergarment apparatus of claim 15, wherein the genital-supportive undergarment apparatus is free from any partitions between an interior-facing side of the fly panel and the interior of the genital-supportive undergarment apparatus.

17. The genital-supportive undergarment apparatus of claim 15, wherein a front edge of the center panel further comprises a first portion aligned with a second portion, wherein the lowermost end of the fly panel is positioned between the first and second portions of the front edge of the center panel.

18. The genital-supportive undergarment apparatus of claim 15, wherein the at least one conduit comprises a fold-over conduit formed from a folded piece of fabric.

19. An adjustable garment apparatus comprising:

two leg panels, a rear panel, a center panel, and a fly panel, each of the panels constructed from a fabric material, wherein the rear panel, the center panel, and the fly panel are connected between the two leg panels;

a waistband connected to at least the two leg panels, wherein two eyelets are positioned in the waistband;

a fly panel seam positioned at an exterior edge of the fly panel, wherein the fly panel seam connects the fly panel to at least the two leg panels and the center panel;

at least one conduit positioned along at least a portion of the fly panel seam, wherein the at least one conduit has two terminating ends positioned at locations adjacent to the waistband and adjacent to an interior surface of the waistband; and a cord having two end portions, the cord positioned within the at least one conduit, wherein the two end portions are positioned exiting the two terminating ends, respectively, and passing through the two eyelets in the waistband, respectively, wherein the two end portions of the cord are crossed over one another between exiting the two terminating ends of the at least one conduit and passing through the two eyelets in the waistband, wherein the cord is movable between at least a tensioned state and an untensioned state, and wherein when the waistband and the fly panel are each in an extended and relaxed configuration, the two terminating ends of the at least one conduit at the two locations adjacent to the waistband have a separated distance that is less than a separated distance between the two eyelets.

* * * * *